United States Patent [19]

Uesaka et al.

[11] Patent Number: 4,488,817

[45] Date of Patent: Dec. 18, 1984

[54] DEVICE FOR MAKING FROZEN CONFECTIONS

[75] Inventors: Susumu Uesaka, Funabashi; Toshio Hagiwara, Tokyo; Akira Yusen, Soka; Minoru Takayama, Ichikawa; Shinichi Urakami, Matsudo, all of Japan

[73] Assignee: Nippon Light Metal Co., Ltd., Japan

[21] Appl. No.: 511,469

[22] Filed: Jul. 7, 1983

[51] Int. Cl.[3] ..... B01F 15/06

[52] U.S. Cl. ..... 366/149; D15/82; 62/342; 220/426; 366/247; 366/293

[58] Field of Search ..... 366/144, 149, 130, 129, 366/197, 200, 201, 279, 242, 244, 246, 247, 252–254, 292, 293, 312, 309, 347; 62/114, 136, 342, 343; 317/76; 220/428, 426; 99/452, 453, 455, 460; D15/82

[56] References Cited

U.S. PATENT DOCUMENTS

| | | | |
|---|---|---|---|
| 1,527,352 | 2/1925 | Feld | 366/149 |
| 1,701,764 | 2/1929 | Roebuck | 220/428 |
| 2,491,952 | 12/1949 | Calmes | 62/114 X |
| 2,557,813 | 6/1951 | Burton | 62/136 |

FOREIGN PATENT DOCUMENTS

| | | | |
|---|---|---|---|
| 463943 | 3/1914 | France | 366/149 |

*Primary Examiner*—Timothy F. Simone
*Attorney, Agent, or Firm*—Eric P. Schellin

[57] ABSTRACT

The device for making frozen confections such as ice cream comprises a double-walled cylindrical vessel having an upper open end and a closed bottom and consisting of a thin aluminum inner vessel member and a thin aluminum outer vessel member with the upper ends thereof hermetically sealingly curled together, the space between the inner and the outer vessel member being filled with a cold keeping agent, an outer receptacle for receiving and supporting the vessel therein with a clearance or heat insulating material provided therebetween, a cover member adapted to engage at its periphery with a ring attached to the upper edge of the double-walled vessel and/or the outer receptacle, and a stirring means extending into the interior of the vessel through a bearing hole formed at the center of the cover member. The freezable cold keeping agent may be cooled and frozen to keep sufficient cold before use so that, when the confectionary to be frozen is placed in the double-walled vessel after the agent has been cooled and frozen, the confectionary is appropriately frozen while it is stirred by the stirring means thereby permitting the frozen confectionary can be prepared.

8 Claims, 2 Drawing Figures

DEVICE FOR MAKING FROZEN CONFECTIONS

BACKGROUND OF THE INVENTION

The present invention relates to a device for making frozen confections such as ice cream and sherbet mainly for use in a home.

Heretofore, a conventional device for making handmade frozen confections such as ice cream comprises an outer vessel and an inner vessel located in the outer vessel with a certain clearance held therebetween, and the clearance is filled with a plurality of broken pieces of ice with a certain amount of salt added thereto so that the inner vessel is cooled by the ice thereby permitting the material for making the frozen confections contained in the inner vessel to be frozen while the material is held in stirred condition.

With such a method described above, the temperature of the broken pieces of ice of the size of about several cm with 15% of salt added thereto reaches theoretically −15 deg. C., but the actual temperature reaches only about −15 deg. C. at the lowest and, since the outer surface of the inner vessel is merely held in point contact with the respective broken pieces of ice, the material contained in the inner vessel can not be cooled rapidly, and, therefore, it takes fairly a long time until the desired frozen confections are completed.

SUMMARY OF THE INVENTION

The present invention aims at avoiding the above described disadvantages of the prior art device for making frozen confections.

It is, therefore, the object of the present invention to provide a novel and useful device for making frozen confections such as ice cream and sherbet which is simple in construction and inexpensive to manufacture and is capable of easily and quickly making frozen confections of a high quality.

The above object is achieved in accordance with the characteristic feature of the present invention by providing a device for making frozen confections such as ice cream comprising a double-walled cylindrical vessel having an upper open end and a closed bottom, the vessel consisting of an inner vessel member and an outer vessel member, the space between the inner vessel member and the outer vessel member being hermetically sealed from the exterior with an appropriate amount of freezable cold keeping agent filled within the space, an outer receptacle adapted to receive and support the vessel therein with a clearance or heat insulating material provided therebetween, a cover member adapted to engage at its periphery with a ring attached to the upper edge of the double-walled vessel and/or the outer receptacle, and stirring means extending into the interior of the vessel through a bearing hole formed at the center of the cover member.

With the above described construction, the device of the present invention makes it possible to easily and quickly make frozen confections by first cooling the double-walled vessel in a refrigerator for about several hours so as to freeze the cold keeping agent to a predetermined low temperature, locating the vessel in the outer receptacle, feeding a predetermined amount of the material for making confections into the vessel, and attaching the cover member onto the vessel and the receptacle with the ring interposed therebetween and the stirring means positioned in position in the vessel, thereby permitting the frozen confections to be easily and quickly made by actuating the stirring means by virtue of the fact that the material is quickly and sufficiently cooled and frozen by the frozen cold keeping agent which contacts with the material through the entire area of the inner vessel member.

The device of the present invention does not require troublesome handling of pieces of ice and can be operated in clean or neat condition in comparison with the use of ice which results in melting of ice and contamination.

The inner vessel member and the outer vessel member are preferably formed by thin aluminum plates with alumilite process applied thereto or a plastic coating applied thereon, and the upper edges of the members are sealingly curled tightly together after the cold keeping agent is filled in the space. This makes it possible to improve the transmission of cold through the inner vessel member and the high durability of the device.

The outer receptacle is preferably made of an integrally molded plastic material with a plurality of supporting lugs provided on the bottom adjacent to the periphery thereof, and the receptacle is preferably provided with a manipulating grip. This makes it possible to manufacture the receptacle at a low cost while the cold dissipation from the outer vessel member outwardly through the receptacle is reduced to the minimum by virtue of the provision of the supporting lugs contacting with the bottom of the vessel in very small areas in addition to the provision of the clearance or the heat insulating material provided between the vessel and the receptacle.

The cold keeping agent preferably comprises water or carbonated water as the base medium with organic or inorganic salts such as alcohol, glycol, ethylene glycol, polypropylene glycol, urea, NaCl and the like added thereto so as to set the melting point of the agent to the range between about −5 deg. C. and −25 deg. C. preferably between about −7 deg. C. and about −17 deg. C., and an organic viscosity increasing agent may be added to obtain an appropriate viscosity of the cold keeping agent.

DETAILED DESCRIPTION OF THE PREFERRED EMBODIMENT

Figure 1:
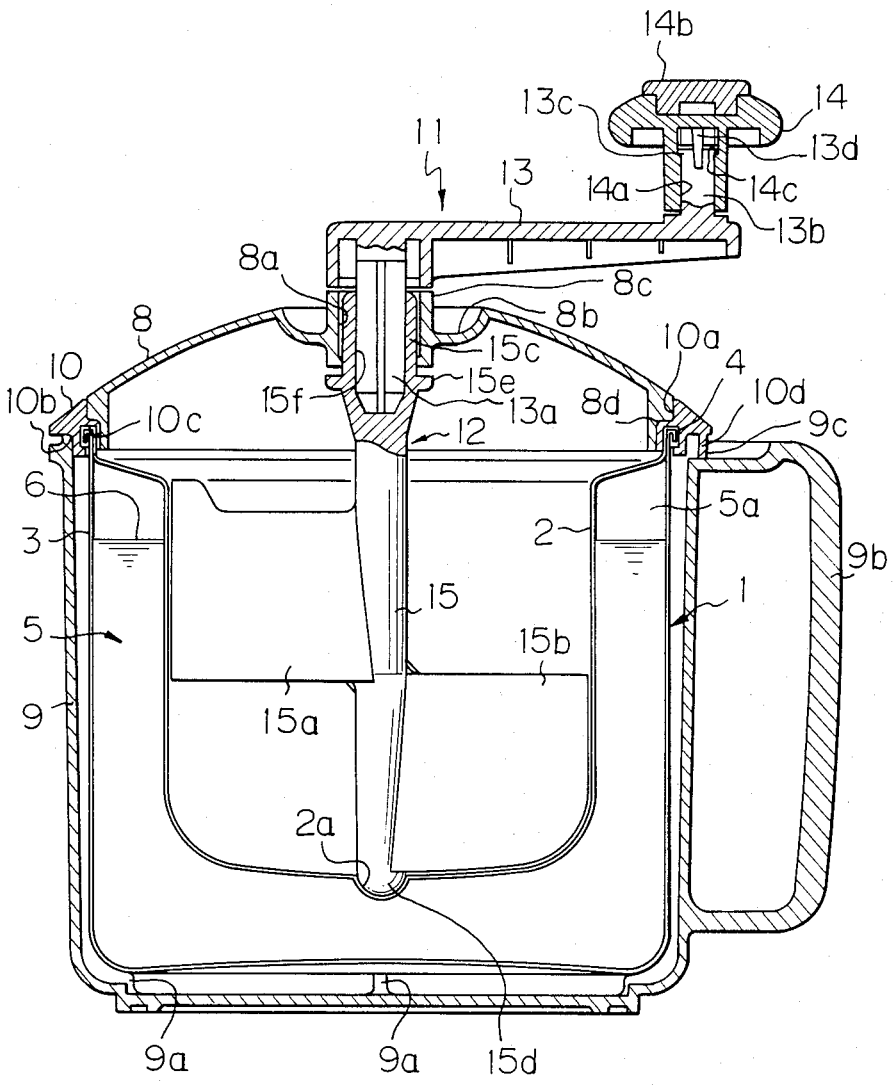
FIG. 1 is a cross-sectional elevational view showing the construction of an embodiment of the device of the present invention.

With reference to FIG. 1 showing an embodiment of the device of the present invention, it comprises a double-walled cylindrical vessel 1 consisting of an inner vessel member 2 and an outer vessel member 3 each having an upper open end and a closed bottom and made of a thin aluminum plate with alumilite process applied thereto. The open upper ends of the inner and outer vessel member 2, 3 are hermetically sealed by curling the upper ends tightly together to form a curled seam 4, wherein an appropriate clearance is held between the cylindrical wall portions as well as the bottoms of the inner vessel member 2 and the outer vessel member 3 so that a space 5 is formed between the two vessel members 2, 3.

A freezable cold keeping agent 6 is filled in the space 5 with a certain amount of air space 5*a* being left at the top of the space 5 in order to prevent the vessel members 2, 3 from being deformed due to the expansion of the volume of the cold keeping agent 6 when it is frozen.

Figure 2:
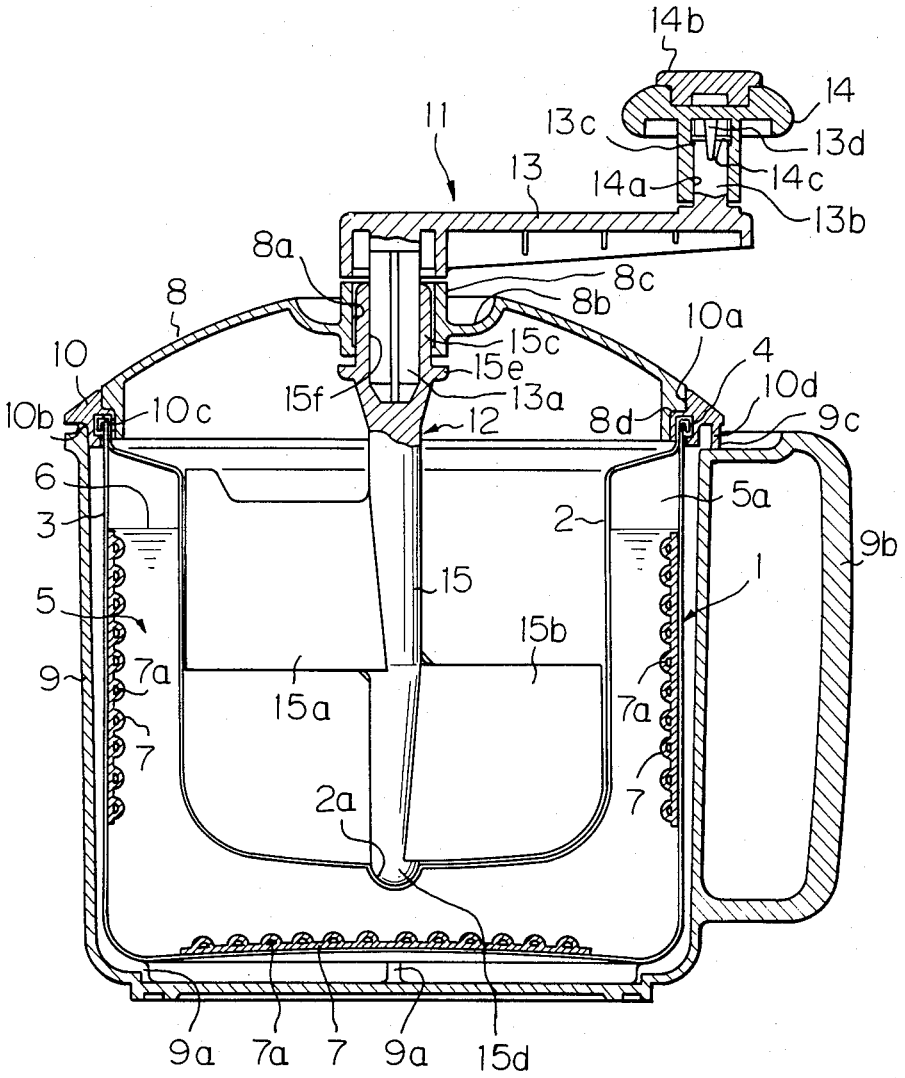
FIG. 2 is a cross-sectional elevational view similar to FIG. 1 but showing another embodiment in which air bag sheets are provided in the cold keeping agent in the double-walled vessel so as to prevent deformation of the vessel due to expansion of the cold keeping agent during the freezing thereof.

Since the cold keeping agent 6 begins to be frozen from the upper portion of the agent 6 downwardly, the compression force will be generated in the lower portion of the agent 6 as the frozen portion increases, it is preferred as shown in FIG. 2 to locate flexible air bag sheets 7 each having a plurality of contractable small air balloons 7*a* secured in appropriately spaced relationship from each other in positions in the cold keeping agent 6 on the inner cylindrical surface and on the upper surface of the bottom of the outer vessel member 3 by securing the sheets 7 thereto, for example, as shown, so that the compression force occurring during the progress of the freezing of the cold keeping agent 6 is absorbed by the construction of the air balloons 7*a* thereby permitting the deformation of the lower portions of the vessel members 2, 3 to be positively prevented.

A part-spherical recess 2*a* is formed at the center of the bottom of the inner vessel member 2 as shown, the purpose of which will be described later.

An inverted-cup shaped cover member 8 made of an integrally molded transparent plastic material is provided which has a central bearing hole 8*a*, a central recess 8*b* for providing a manipulatable knob 8*c* and a peripheral shoulder portion 8*d*, the purpose of which will be described later.

In order to appropriately support the double-walled vessel 1 during the operation of the device, an outer receptacle 9 made of an integrally molded plastic material is provided which is adapted to receive and support the vessel 1 therein with an appropriate clearance held between the outer cylindrical wall of the outer vessel member 3 and the inner cylindrical wall of the receptacle 9 as well as between the bottom of the outer vessel member 3 and the bottom of the receptacle 9.

In order to support the vessel 1 in position in the receptacle 9, a plurality of thin supporting lugs 9*a* are integrally provided on the upper surface of the bottom of the receptacle 9 adjacent to the periphery thereof. Thus, the vessel 1 is held in the receptacle 9 in the most effective manner preventing dissipation of cold from the vessel 1 outwardly through the receptacle 9.

The space between the vessel 1 and the receptacle 9 may be filled with heat insulating material in order to enhance the heat insulating capacity.

In order to facilitate the handling of the receptacle 9, a hand grip 9*b* is provided.

In order to sealingly couple the receptacle 9, the double-walled vessel 1 and the cover member 8 together, a soft, flexible coupling ring 10 made of a soft, flexible plastic material or rubber is provided, which has an inner peripheral shoulder portion 10*a* snugly mating with the peripheral shoulder portion 8*d* of the cover member 8, an outer peripheral shoulder portion 10*b* snugly engaging with the upper inner peripheral edge of the receptacle 9 and an annular groove 10*c* formed in the lower surface the the ring 10 for snugly receiving the curled seam 4 of the vessel 1 as shown.

In order to prevent relative rotation of the vessel 1 with respect to the receptacle 9 during the operation of the device, a rotation preventing depending lug 10*d* is formed on the lower surface of the ring 10 which is received in the rotation preventing recess 9*c* formed in the upper portion of the grip 9*b*.

In order to stir the material fed in the inner vessel member 2 for making frozen confections, stirring means is provided which comprises an upper component 11 located above the cover member 8 and a lower component 12 located beneath the cover member 8 and in the inner vessel member 2.

The upper component 11 consists of a handle arm 13 having a coupling portion 13*a* of non-circular cross-section integral with the handle arm 13 and extending downwardly from the proximal end of the arm 13 as well as a coupling portion 13*b* of circular cross-section integral with the handle arm 13 and extending upwardly from the distal end of the arm 13, and a manipulating knob 14 having a downwardly extending sleeve portion 14*a* rotatably engageable with the coupling portion 13*b* and a cap 14*b* removably attached to the top of the knob 14. In order to releasably engage with and hold the coupling portion 13*b* in the sleeve 14*a*, the upper portion of the coupling portion 13*b* is made hollow and an enlarged diameter portion 13*c* and a plurality of vertical slits 13*d* are formed at the hollow portion of the coupling member 13*b* so that the coupling portion 13*b* can be inserted into the sleeve 14*a* by contracting the diameter of the enlarged diameter portion 13*c* by virtue of the provision of the slits 13*d* and thereafter engaging the enlarged diameter portion 13*c* with the shoulder portion 14*c* of the knob 14 formed in the sleeve 14*a*.

The lower component 12 consists of a rotatable shaft 15 having an upper stirring blade 15*a* and a lower stirring blade 15*b* fixedly secured thereto, respectively, as shown.

The shaft 15 has a bearing portion 15*c* at its upper end rotatably fitting in the sleeve 8*a* of the cover member 8 and a lower end 15*d* in the semi-spherical form rotatably fitting in the part-spherical recess 2*a* of the inner vessel member 2 so that the shaft 15 is rotatably supported vertically in the inner vessel member 2.

In order to prevent the shaft 15 from being moved excessively upwardly during the operation, a flange 15*e* is formed in the shaft 15 at a position adjacent to the lower end of the sleeve 8*a*.

In order to rotate the lower component 12 by the upper component 11, the bearing portion 15*c* of the shaft 15 is formed with a recess 15*f* of the complementary cross-section to the non-circular cross-section of the coupling portion 13*a* of the handle arm 13, the recess 15*f* being snugly fitted with the coupling portion 13*a* so that the shaft 15 can be rotated by rotating the handle arm 13 by means of the knob 14.

The blades 15*a*, 15*b* are secured to the shaft 15 at a slight angle axially thereof so that, when the shaft 15 is rotated, the content fed in the inner vessel member 2 is stirred downwardly by the upper blade 15*a*, while it is stirred upwardly by the lower blade 15*b*, thereby permitting the content to be sufficiently mixed up to provide high quality frozen confections. The arrangement of the blades 15*a*, 15*b* is also effective to mix air bubbles in the material to make soft cream.

The operation of the above described device of the present invention will be described below.

The double-walled vessel 1 is first cooled in a refrigerator for several hours so as to cause freezing of the cold keeping agent 6.

Then the vessel 1, the receptacle 9 and the cover member 8 are sealingly assembled by using the ring 10 after the lower component 12 is located in the inner vessel member 2 and a predetermined amount of the material for making frozen confections is fed therein. Then the upper component 11 is coupled with the lower component 12.

The material begins to be frozen in a thin layer on the inner surface of the inner vessel member 2 which is scraped off by the blades 15*a*, 15*b* as the shaft 15 is rotated by driving the knob 14. After about several minutes, the material is rendered to form well mixed frozen confections such as ice cream and sherbet.

It is also possible to couple an electric motor with the lower component 12 directly or through a reduction gear so as to dispense with manual handling of the stirring means.

After the frozen confections are completed, the stirring means is removed and the cap 14*a* is fitted in the bearing hole 8*a* of the cover member 8 for sealing purpose.

EXAMPLE

Conditions

| Conditions | |
|---|---|
| Thickness of the inner and outer vessel members 2, 3 | = 0.7 mm |
| Volume of the space 5 between the inner and outer vessel members 2, 3 | = 500 cc |
| Volume of the cold keeping agent 6 | = 430 cc (filling rate 86%) |
| Melting point of the cold keeping agent 6 | = −12 ± 2 deg. C |
| Temperature of the refrigerator | = −18 ± 2 deg. C |
| Duration of refrigeration | = 6 ± 1 hours |
| Material for frozen confections | = raw cream 200 cc<br>2 raw eggs 130 g<br>sugar 80 g |
| Temperature of the material | = 8 ± 1 deg. C |

Results

The time for completing the operation:

| | Temperature | Time |
|---|---|---|
| Soft cream | −2 deg. C | 8 ± 2 min. |
| Ice cream | −3.5 deg. C | 25 ± 5 min. |

It has been proved that the filling rate of the cold keeping agent 6 in the space 5 must be equal to or greater than 75%. An inert gas may be filled in the space 5*a* in place of air.

It has also been proved that the melting point of the cold keeping agent 6 is preferably set to the range of −7 deg. C. and −17 deg. C. in light of the temperature of the refrigerator of −18 deg. C., while good results can not be obtained when the melting point is set to equal to or higher than −6 deg. C.

As described above, the present invention provides a device for making frozen confections which requires very short time for making the frozen confections and which is easy to handle and can be used repeatedly in cleanliness, and, since the parts of the device can be easily disassembled, it is made compact and easily transported. The ring effectively prevents the operator from being hurt by frostbite.

By virtue of the cold keeping capacity of the cold keeping agent, it is possible to maintain the completed frozen confections in the vessel at a constant low temperature for a long time period, and the frozen confections can maintain their sweet taste until cold keeping agent loss its cold keeping effect by dissipating cold therefrom during the use.

Further, it is made possible to set the time period required for freezing the cold keeping agent as well as the time period in which the completed frozen confections can be kept in the frozen state to any desired value by merely adjusting the quantity of the cold keeping agent filled in the space between the walls of the inner and outer vessel members of the double walled vessel, thereby affording a remarkable effectiveness.

What is claimed is:

1. Device for making frozen confections such as ice cream comprising:

a double-walled cylindrical vessel having an upper end and a closed bottom, said vessel comprising an inner vessel member and an outer vessel member, a space is formed between said inner vessel member and said outer vessel member which is hermetically sealed and filled with a cold keeping agent;

a ring having an inner periphery and an outer periphery, the inner periphery is provided with an annular groove and an inner supporting shoulder, and the outer periphery is provided with an annular supporting shoulder, the upper end of said double-walled vessel being embracingly fitted in said groove of said ring;

an outer receptacle having an upper open end forming an upper edge and a closed bottom;

said double-walled cylindrical vessel being located within said outer receptacle, wherein said supporting shoulder of said ring is engaged with the upper edge of said outer receptacle so as to be supported thereby;

a cover member having a periphery adapted to engage at its periphery the inner supporting shoulder of the inner periphery of said ring, said cover member is also provided with a bearing hole, and a stirring means journaled in the bearing hole of said cover member and provided with agitating blades positioned in said double-walled vessel.

2. Device according to claim 1, wherein said ring is formed with a projected portion and said outer receptacle is formed with a mating recessed position snugly receiving said projected portion so as to prevent the relative rotation therebetween.

3. Device according to claim 1, wherein said outer receptacle is formed with a projected portion and said ring is formed with a mating recessed portion snugly receiving said projected position so as to prevent relative rotation therebetween.

4. Device according to claim 1, wherein said cover member is formed with at least one projected portion, and said ring to formed with a corresponding mating recessed portion snugly receiving said projected portion so as to prevent relative rotation therebetween.

5. Device according to claim 1, wherein said ring is formed with at least one projected portion and said cover member is formed with a corresponding mating recessed portion snugly receiving said projected portion so as to prevent relative rotation therebetween.

6. Device according to claim 1, wherein said cover member is formed with at least one projected portion and said outer receptacle is formed with a corresponding mating recessed portion snugly receiving said projected portion so as to prevent relative rotation therebetween.

7. Device according to claim 1, wherein said outer receptacle is formed with at least one projected portion and said cover member is formed with a corresponding mating recessed portion snugly receiving said projected portion so as to prevent relative rotation therebetween.

8. Device according the claim 1, wherein each of said inner vessel member and said outer vessel member is formed by a thin aluminum plate with alumilite process applied thereto, each of said members provided with upper edges which are sealingly curled tightly together after said cold keeping agent is filled in said space; said outer receptacle is made of an integrally molded plastic material with a plurality of supporting lugs for supporting said vessel being provided on the bottom of said receptacle, said receptacle is also provided with a manipulating grip; said ring is made of a soft deformable material and such a cross-section so that the inner cover supporting shoulder is formed at its inner periphery, and the annular receptacle supporting shoulder is formed at its outer periphery, while a vessel engaging annular groove is formed at its inner periphery; said stirring means comprises a lower component consisting of rotatable shaft rotatably supported at its upper end in said bearing hole of said cover member and rotatably supported at its lower end by a recess formed at the center of the bottom of said inner vessel member of said double-walled vessel, and at least a pair of stirring blades secured to said shaft at positions so as to extend radially outwardly therefrom to reach adjacent to the inner periphery of said double-walled vessel, and each positioned in upper and lower diagonal relative positions to each, said pair of blades being generally in parallel to the axis of said shaft with an inclination of about 10–20 degrees formed between the axis of said shaft and said blades, and an upper component consisting of a male coupling member of non-circular cross-section engaging with a complementary recess in said shaft for coupling said shaft with said upper component, a handle arm radially outwardly extending form said coupling member and a manipulating knob provided at the free end of said handle are, and said cold keeping agent comprises water as the base medium with salts added thereto so as to set the melting point of said agent to the range between about −5 degree C. and −25 degree C.

* * * * *